United States Patent [19]

Padilla

[11] Patent Number: 4,955,148

[45] Date of Patent: Sep. 11, 1990

[54] FOOT SUPPORT ASSEMBLY

[76] Inventor: Rigoberto Padilla, 801 W. 48th St., Hialeah, Fla. 33012

[21] Appl. No.: 338,187

[22] Filed: Apr. 14, 1989

[51] Int. Cl.[5] ..... A43B 13/38; A61F 5/14

[52] U.S. Cl. ..... 36/44; 36/43; 128/617; 128/615

[58] Field of Search ..... 36/43, 44; 128/614, 128/615, 619, 620, 621, 617

[56] References Cited

U.S. PATENT DOCUMENTS

| | | | |
|---|---|---|---|
| 2,081,474 | 5/1937 | Burns | 128/615 |
| 2,423,622 | 7/1947 | Samblanet | 128/617 |
| 2,546,408 | 3/1951 | Riggs | 36/43 |
| 2,660,814 | 12/1953 | Ritchey | 128/619 |
| 2,681,515 | 6/1954 | Frese, Jr. | 128/619 |
| 2,857,689 | 10/1958 | Van Ostrom et al. | 128/617 |
| 2,949,685 | 8/1960 | Burns | 128/619 |
| 3,084,695 | 4/1963 | O'Donnell | 128/615 |
| 3,861,398 | 1/1975 | Leydecker | 128/615 |

FOREIGN PATENT DOCUMENTS

| | | | |
|---|---|---|---|
| 588504 | 12/1959 | Canada | 128/617 |
| 282064 | 4/1952 | Switzerland | 128/619 |

*Primary Examiner*—Steven N. Meyers

*Attorney, Agent, or Firm*—Malloy, Downey & Malloy

[57] ABSTRACT

The present invention is directed towards a support assembly designed to supportingly engage selected portions of the bottom of the foot so as to provide adequate support to these various portions thereby relieving various maladies of the foot which may be attendant to the wearing of modern day shoes and in women, the wearing of high heeled shoes. The support structure includes a plurality of supports structured into a substantially unitary construction and engaging an appropriate portion of the under part of the foot so as to provide support to the intended areas, including but not limited to the arch, external side of the foot, heel and metatarsal region of the foot.

6 Claims, 1 Drawing Sheet

FOOT SUPPORT ASSEMBLY

BACKGROUND OF THE INVENTION

1. Field of the Invention

The present invention relates to a support designed to fit within a conventional shoe and concurrently engage predetermined portions of the undersurface of the foot and thereby add support thereto in an effort to overcome certain foot disorders.

2. Description of the Prior Art

It is well recognized in the medical profession that certain stresses are placed on the foot resulting in the exertion of certain unbalanced forces being placed thereon. This in turn frequently results in pain and discomfort of the foot which at least to some extent, may be attributable to the wearing of modern day shoes. In particular, women frequently wear what is commonly known as "high heel" shoes which place an unbalanced force on various portions of the foot and which serve to effectively force the toes of the foot into a very stressed position. In order to overcome many of these problems, various braces and/or supports have been developed which have a tendency to balance out the unequal forces.

For example, Burns U.S. Pat. No. 2,081,474; discloses a cuboid-metatarsal arch support assembly defined by a pad preferably of a soft rubber material extending across the support and increasing in width from the back to the first metatarsal and to the fifth metatarsal as well as other designated and intended portions of the foot. The pad support structure does in fact fit in the interior of a shoe and engages the under portion of the foot at various portions.

Castellanos, U.S. Pat. No 4,571,857; discloses a foot support for use in foot wear which are molded of polypropylene sheet and include a network of longitudinal and transverse reinforcing ribs integrally molded with the support and extending across an arch-supporting area thereof. The ribs as well as the other components of the molded structure serve to resist stresses on the support during wear and maintain the shape of the support without adversely affecting its resiliency.

Sigle, U.S. Pat. No. 4,317,293; discloses a foot-supporting insole type structure having a front bounding line extending in front of the ball of the little toe at the outside of the foot and behind the ball of the big toe at the inside of the foot. The structure is made of resiliently elastic material of substantially constant thickness and is constructed so that it is curved upwardly at the inside of the foot and further includes stiffness of the insole at least at the outside zone thereof.

Accordingly, the structures disclosed in the above-noted patents are ample evidence that numerous attempts have been made throughout the prior art to solve problems of the problem patients with foot pain or disorders. As set forth above, some of the mentioned disorders are caused by an unbalanced force being continuously or repetitively placed on the foot due to walking in modern day shoes which may be rather restrictive in configuration and structure. It is of course understood that not all of the pain and attendant difficulties with the foot are attributable to modern day footwear. However, the utilization of a properly structured brace or support assembly, whether it be attached directly to the foot or, in a preferred embodiment, used as an insole type structure, and further used on a substantially continuous basis would greatly aid in the elimination of pain and/or other major and minor discomforts associated with the foot.

SUMMARY OF THE INVENTION

The present invention relates to a foot support assembly of the type which is primarily designed to engage the under portion of the foot or more particularly certain portions thereof and in doing so, provides a more balanced force applied to the foot. In a preferred embodiment of the present invention, the support assembly is designed for removable placement on the interior of a shoe. The assembly includes a support platform formed of a substantially unitary construction and including a resilient, cushioning material of corresponding dimension and configuration to accomplish proper fitting within a given shoe style while at the same time allowing for proper disposition of certain predetermined support portions thereof into supporting engagement with intended under portions of the subject foot.

In more specific terms, the support platform includes a heel support located at the posterior end of the platform and formed into a curvilinear or substantially horse shoe configuration being further defined by an elongated centrally disposed recess channel portion. The exposed surface of the recess channel is, as set forth above, recessed or disposed below the outer or exposed surface of the remainder of the heal support. This "raised" portion extends upwardly into cushioning but yet supporting engagement with the correspondingly configured portion of the under surface of the heel of the subject foot.

The support platform is further defined by an arch support having a somewhat elongated and curved configuration and extending upwardly or outwardly from the remainder of the support platform in substantial conformance with the arch portion of the foot and into cushioning but yet supporting engagement therewith. The longitudinal and transverse dimensions of the arch support are such as to engage a vast majority of the under portion of the foot defining the arch so as to apply the aforementioned balancing forces thereto.

The support platform yet further includes an external side support disposed in spaced relation to the arch support and extending along an opposite longitudinal side of the support platform relative to the arch support. While the configuration of the side support is elongated, it is additionally defined by a lesser longitudinal dimension than the arch support so as to supportingly engage and yet at least partially cushion preferably a portion of the length of the exterior side of the under portion of the subject foot.

The support platform is yet further defined by an included metatarsal support extending transversely across the width substantially adjacent one end of the support platform and having a sufficient elongated configuration for selected placement in supporting relation to the metatarsal region of the foot. The support platform includes a recessed portion covering what may be considered a majority of the exposed surface area of the support platform and which may include the aforementioned centrally disposed recess channel associated with the heel support. The recess portion is defined by a lesser overall thickness than any of the aforementioned supports and accordingly is deliberately disposed, structured and configured to provide a substantially none-supportive engagement with a majority of the undersurface of the foot. It is understood of course, that the recessed portion in fact does engage the under surface portion but due to the increased and possible varying heights of the aforementioned supports, such supports provide more of supporting and balanced forces to the engaged undersurface portions of the foot which are cooperatively contacted by the individual supports.

The invention accordingly comprises the features of construction, a combination of elements, an arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detail description taken in connection with the accompanying drawings in which.

Like reference numerals refer to like parts throughout the several views of the drawings.

DETAILED DESCRIPTION OF THE DRAWINGS

Figure 1:
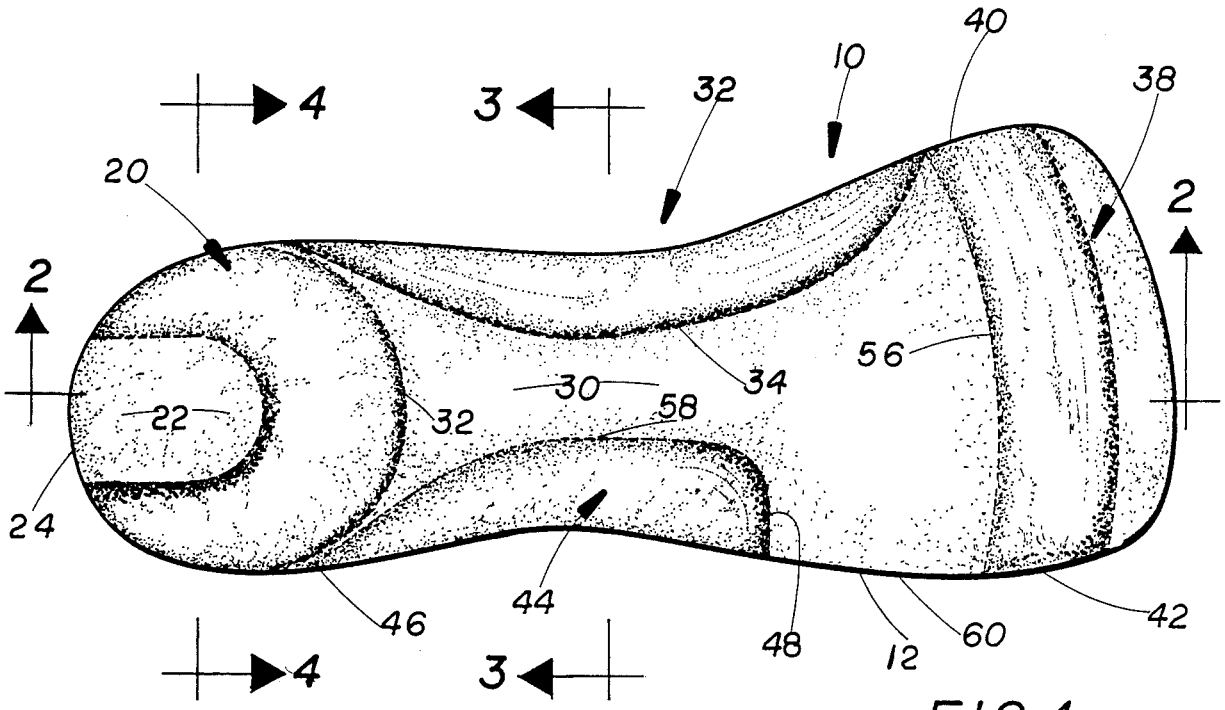
FIG. 1 is a top plan view of the preferred embodiment of the present invention.
Figure 2:
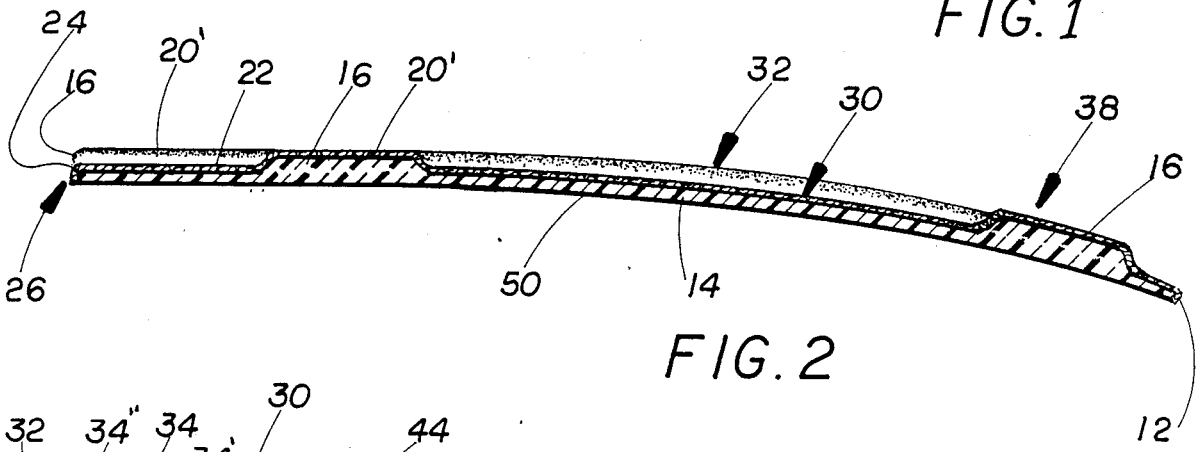
FIG. 2 is a longitudinal sectional view taken along line 2—2 of FIG. 1.
Figure 3:
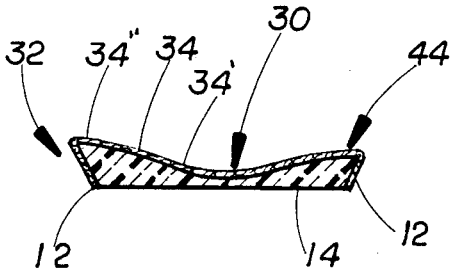
FIG. 3 is a sectional view taken along line 3—3 of FIG. 1.
Figure 4:
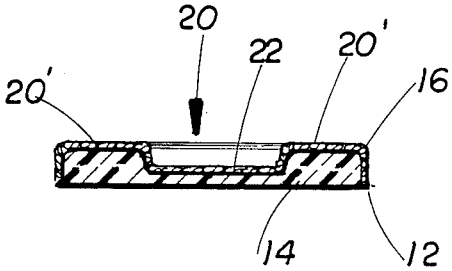
FIG. 4 is a sectional view taken along line 4—4 of FIG. 1.

As shown in FIGS. 1 through 4, the foot support assembly of the present invention is generally indicated as 10 and comprises a support platform 12. As best shown in FIGS. 2, 3 and 4, the platform 12 is formed of a substantially resilient and at least partially cushioning material. In the preferred embodiment (see FIG. 2), the platform 12 has an integrally formed base as at 14 molded into the preferred configuration to define a plurality of supports integrally formed thereon. A cover member 16 is disposed in overlying and covering relation to the confronting surface of the base 14 and thereby defines a one piece, unitary construction.

The support platform 12 is defined by a heel support generally indicated as 20 and including a curvilinear, elongated configuration defined into what may be termed a horse shoe or U-shaped configuration which includes a centrally disposed, somewhat elongated channel 22 formed therein. With reference to FIGS. 2 and 4, the channel 22 is recessed to extend below the elongated portion 20' of the heel portion 20 as Will be explained in greater detail hereinafter. The elongated channel 22 further is defined by an opened end 24 contiguous to the posterior end or extremity generally indicated as 26 (see FIG. 2) of the support platform 12. The height of the elongated, recessed channel 22 extends below the remainder of the heel portion 20, as set forth above, as does a central recessed segment or portion 30 extending along a majority of the length of the support platform 12. Both the central recessed portion 30 and the recess channel 22 are disposed so as to possibly engage the under portion of the foot while at the same time not providing significant supporting or balancing forces to the under portion of the foot which it does engage. Such will be defined with greater clarity with regard to the other supports defining the support platform 12.

The platform 12 further includes an arch support generally indicated as 32 having an elongated configuration and extending along a major portion of the length of the interior side of the foot and support platform 12 in engaging relation with the arch of the under portion of the foot. The arch support 32 is also configured to have an upwardly extending or projecting portion (see FIG. 3) indicted as 34 which may vary from an inner end 34' to an outer end 34" This again is to provide a configuration which corresponds to and provides adequate balancing support to the arch along a major portion of its length and width.

The support platform 12 further includes a metatarsal support generally indicated as 38. The metatarsal support 38 extends transversely across the width of the support platform 12 wherein opposite ends as at 40 and 42 correspond in aligned relation with opposite sides of the support platform 12. Accordingly, the metatarsal region of the foot is also adequately supported and has proper balancing and support forces being exerted thereon.

The support platform 12 is yet further defined by an external side support 44 having a somewhat elongated configuration and extending from the heel support 20 at one end 46 towards but in spaced relation to the metatarsal support 38 as at 48. Accordingly, balancing support and force is provided to the outer or side of the foot along a length thereof which is contacted by the side support 44.

While in the embodiment shown each of the various supports 20, 32, 38 and 44 have a height significantly greater than that of the central recess portion 30 and recess channel 22, such heights may in fact vary from one another but yet are determined based upon the particular malady to which the foot is subject. For example, the outer extent or rise of the heel portion is preferably in the range of ⅛ inch extending continuously along its curvilinear length. Similarly, the metatarsal support 28 also raises upwardly ⅛ inch from the recessed portion 22, 30 substantially continuously along its length. The same height perimeters are also in existence with regard to the side support 44. Namely, the side support extends upwardly from the central recess segment or portion 30 at least ⅛ inch.

As shown in FIG. 3, the arch support 32 has a substantially varying height as it extends at one peripheral edge 34' to its outer peripheral edge 34" wherein the maximum height of the outer peripheral edge is in the range of approximately 3/16 of an inch above the recess segment or portion 30. A preferred height of the recessed segment 30 as well as the recess channel 22 is preferably 1/16 inch from the under surface of the base 50. Such height or thickness is measured to include the cover 16.

Other structural features are clearly shown in FIG. 1 which include the boundaries of the central portion 30 being substantially defined by the inner peripheral edges 52, 54, 56 and 58 of the respective supports 20, 32, 38 and 44. As set forth above, the longitudinal dimension of the side support 44 is such that the end thereof 48 is spaced from the metatarsal support 38 thereby extending the central recess portion or segment 30 to a contiguous alignment with the outer side as at 60.

Now that the invention has been described,

What is claimed is:

1. Any foot support assembly designed for placement within a shoe in supporting engagement with the bottom of a foot, said assembly comprising:

a. a support platform formed of a resilient cushion material and having a first main face and a second main face, said first main face structured and configured to engage predetermined portions of the undersigned of the foot, b. a heel support formed on a posterior end of said first main face and having an elongated substantially curvilinear horse shoe configuration extending along its length in surrounding relation to a recessed central elongated channel having an open end disposed adjacent to said posterior end, said heel support positioned beneath an engaging relation to the heel of the foot, c. an arch support formed on an inner edge of said first main face having a curved configuration in substantial conformance with an arc portion of the foot and having sufficient length to extend along at least a major portion of the length of the arch of the foot, d. an external side support formed on an outer edge of said first main face having an elongated configuration oppositely disposed relative to said arch support and extending along an external side portion of the foot in supporting, engaging relation thereto, e. a metatarsal support formed on an upper end of said first main face opposite to said heel support and having an elongated arcuate configuration of substantially uniform width extending transversely across said first main face in supporting relation to the metatarsal region of the foot, said metatarsal foot having opposite ends thereof disposed adjacent to correspondingly positioned opposite sides of the support platform, f. a recessed portion on said first main face interconnecting and extending between said supports, and g. said supports extending above said recessed portion to a sufficiently greater height to accomplish supporting engagement with a corresponding under surface portion of the foot.

2. An assembly as in claim 1 wherein each of said supports comprises an inner peripheral edge portion collectively disposed to at least partially define peripheral boundaries of a center segment of said recessed portion, said center segment disposed in none-supporting relation to a substantially central underportion of the foot.

3. An assembly as in claim 2 wherein said center segment extends along a major length of the under portion of the foot between the inner peripheral edges of the heel support and the metatarsal support.

4. An assembly as in claim 1 wherein said central channel is recessed inwardly from a remainder of said horse shoe configuration and in none-supporting engagement with the under portion of the foot.

5. An assembly as in claim 1 wherein said external side support has a lesser longitudinal dimension than said arch support and has one end thereof, opposite to said heel support, disposed in spaced relation to said metatarsal support.

6. An assembly as in claim 1 wherein said metatarsal support comprises a substantially elongated, arcuate configuration along its length and extends outwardly away from the central segment towards the toes of the foot.

* * * * *